US008650752B2

(12) United States Patent
Yoshimura

(10) Patent No.: US 8,650,752 B2
(45) Date of Patent: Feb. 18, 2014

(54) METHOD FOR MANUFACTURING VALVE UMBRELLA PORTION OF HOLLOW ENGINE VALVE, PRESS DEVICE OF VALVE UMBRELLA PORTION OF HOLLOW ENGINE VALVE, AND HOLLOW ENGINE VALVE

(75) Inventor: Hyoji Yoshimura, Nagoya (JP)

(73) Assignees: Mitsubishi Heavy Industries, Ltd., Tokyo (JP); Yoshimura Company, Aichi (JP)

( * ) Notice: Subject to any disclaimer, the term of this patent is extended or adjusted under 35 U.S.C. 154(b) by 0 days.

(21) Appl. No.: 13/502,902

(22) PCT Filed: Jul. 15, 2010

(86) PCT No.: PCT/JP2010/061933

§ 371 (c)(1),
(2), (4) Date: May 24, 2012

(87) PCT Pub. No.: WO2011/077776

PCT Pub. Date: Jun. 30, 2011

(65) Prior Publication Data

US 2012/0228538 A1 Sep. 13, 2012

(30) Foreign Application Priority Data

Dec. 24, 2009 (JP) ..... 2009-292226

(51) Int. Cl.
*B21K 1/22* (2006.01)

(52) U.S. Cl.
USPC ..... 29/888.092; 29/888.451; 29/888.452; 29/888.46; 29/34 R; 123/188.3; 137/15.18; 137/315.27; 251/318; 251/366

(58) Field of Classification Search
USPC ..... 29/888.092, 888.451, 888.452, 888.46, 29/34 R; 251/318, 366; 137/15.18, 15.01, 137/315.27; 123/188.3
See application file for complete search history.

(56) References Cited

U.S. PATENT DOCUMENTS

| | | | | |
|---|---|---|---|---|
| 1,950,953 | A * | 3/1934 | Serimgeour | 123/188.3 |
| 2,004,528 | A * | 6/1935 | Hedlund | 29/888.451 |
| 2,450,803 | A * | 10/1948 | Johnson | 29/888.451 |

(Continued)

FOREIGN PATENT DOCUMENTS

| | | |
|---|---|---|
| EP | 2 325 446 A1 | 5/2011 |
| EP | 2 541 000 A1 | 1/2013 |

(Continued)

OTHER PUBLICATIONS

"Heat treatment of steel, revised 5th edition", (edited by The Iron and Steel Institute of Japan), Maruzen Co., Ltd., 2nd edition, 3rd issue, 1979, 8 pages provided (with concise English explanation).

(Continued)

*Primary Examiner* — John Bastianelli
(74) *Attorney, Agent, or Firm* — Birch, Stewart, Kolasch & Birch, LLP

(57) ABSTRACT

A semi-finished product having a hollow and an expansion diameter portion is manufactured in advance (first step), and a press device for folding an outer cylinder (4) and an inner cylinder (5) around an entire die set (DS) is used, thereby performing drawing with a body of the semi-finished product as the center in a constant temperature atmosphere at any temperature between a room temperature and 870° C. (second step).

4 Claims, 9 Drawing Sheets

(56) References Cited

U.S. PATENT DOCUMENTS

| | | | | | |
|---|---|---|---|---|---|
| 2,627,259 | A | * | 2/1953 | Wood et al. | 123/188.3 |
| 4,597,367 | A | * | 7/1986 | Hayashi | 123/188.3 |
| 5,056,219 | A | * | 10/1991 | Iwase | 29/888.451 |
| 6,009,843 | A | * | 1/2000 | Griffin et al. | 123/188.3 |
| 2007/0125976 | A1 | * | 6/2007 | Stark et al. | 251/356 |
| 2011/0174259 | A1 | | 7/2011 | Yoshimura | |

FOREIGN PATENT DOCUMENTS

| | | | |
|---|---|---|---|
| JP | 63-195308 | A | 8/1988 |
| JP | 7-102917 | A | 4/1995 |
| JP | 7-208127 | A | 8/1995 |
| JP | 2001-225139 | A | 8/2001 |
| JP | 2009-18565 | A | 8/2009 |
| JP | 4390291 | B1 | 12/2009 |

OTHER PUBLICATIONS

Leslie, "The Physical Metallurgy of Steels", (supervising translation by N. Koda), Maruzen Co., Ltd., 2nd issue, 1987, 17 pages provided (with concise English explanation).

* cited by examiner

P1(P)
Wa(111)
H
Wb(112)
W(11)

P1(P)
Wa(111)
Wb(112)
α
W(11)
H

P1(P)
Wa(111)
H
Wb(112)
Z
X
W(11)
Dr
D1(D)

P1(P)
Wa
H
Wb
Z
X
W
Dr
D2(D)

P1(P)
Wa
H
Wb
Z
W
H
Wa
Dr
DM(D)

P1(P)
Wa
H
Wb
Z
X
W
H
Wa
Dr
DN(D)

P1(P)
Wa(1a)
H
Wb
(1b)
W(1)
H
Wa
(1a)

W(1)
H
β
Wa(1a)
P1(P)
Wb
(1b)

METHOD FOR MANUFACTURING VALVE UMBRELLA PORTION OF HOLLOW ENGINE VALVE, PRESS DEVICE OF VALVE UMBRELLA PORTION OF HOLLOW ENGINE VALVE, AND HOLLOW ENGINE VALVE

TECHNICAL FIELD

This invention relates to a method for manufacturing a valve umbrella portion of a hollow engine valve which has a valve umbrella portion hollow open at a side to be welded to a shaft end sealing material or to a hollow shaft portion, and in which the valve umbrella portion hollow is formed with an expanded diameter within an expanded-diameter section of the valve umbrella portion, and the maximum inner diameter of the valve umbrella portion hollow is larger than the maximum outer diameter of the hollow shaft portion; a press device for the valve umbrella portion of the hollow engine valve; and the hollow engine valve having the valve umbrella portion.

BACKGROUND ART

In regard to a method for manufacturing a valve umbrella portion of a hollow engine valve, the inventor of the present application made the invention of Patent Document 1 to be described below. Its outline will be given as follows: The valve umbrella portion of the hollow engine valve, particularly in an exhaust valve, is exposed to high temperatures. For the valve umbrella portion, therefore, use has been made of materials showing excellent properties including heat resistance, such as heat resisting steels based on manganese, nickel, chromium, etc.

These materials have the advantage of being highly resistant to heat, but also has the disadvantage of being poor in plastic workability. That is, it is difficult to forge them into the finished form of the valve umbrella portion, and a hollow has to be provided in the hollow engine valve, thus making working even more difficult. Thus, in forming the valve umbrella portion by forging such a material, it has been common practice to raise the temperature of the material to a value equal to or higher than its recrystallization temperature, and carry out working by hot forging.

With hot forging, however, the results are necessarily poor such that working accuracy declines owing to the problem of metal expansion or the like, and that the texture of the surface of the product is inferior to that in cold forging.

Under these circumstances, the inventor of the present application sought a method for forming a valve umbrella portion by cold forging, not hot forging, with the use of a material with high heat resistance as mentioned above. By trial and error, the inventor worked out a method comprising producing, first, a valve umbrella portion semifinished product in which the maximum outer diameter of an expanded-diameter section agrees with the maximum outer diameter of the valve umbrella portion as a finished product, and which has a cylindrical hollow with a bottomed lower end having the same inner diameter as the maximum inner diameter of a valve umbrella portion hollow of the valve umbrella portion as the finished product; and then gradually drawing the semifinished product in a plurality of stages by cold forging, with the upper part of the expanded-diameter section and the body being targeted, to prepare the valve umbrella portion as the finished product. The inventor filed an application for this method, and this application was granted a patent right (Patent Document 1 to be described below).

As the materials for the valve umbrella portion, the following three types were named:

| |
|---|
| NCF 47W (nickel-based steel) |
| SUH 35 (austenitic manganese-based steel) |
| Inconel 751 (nickel-based steel) |

The inventor of the present application repeated, many times, confirmation experiments on the above materials even after acquisition of the patent right of the Patent Document 1. As a result, NCF 47W and Inconel 751 were confirmed to obtain a valve umbrella portion as a finished product, without any problem, by the method of the Patent Document 1. Materials with a high carbon content included in JIS 4311 heat resisting steels (SUH 35 also included therein) were found to show trouble, such as cracking or deformation, slightly more frequently than NCF 47W and Inconel 751, when all stages of necking (drawing) were performed by cold forging.

In recent years, demand has tended to surge for the low fuel consumption of vehicles, and there has been a tendency to demand that all vehicle components be compact and lightweight. With such trends, hollow engine valves have attracted attention, particularly, because of the weight reduction of members which repeat rapid reciprocating motions within an engine. The tendency is growing toward a keen desire for highly accurate forging using various materials including materials with unsatisfactory cold forgeability.

PRIOR ART DOCUMENTS

Patent Documents

Patent Document 1: Japanese Patent No. 4,390,291

Non-Patent Documents

Non-patent document 1: "Heat treatment of steel, revised 5th edition" edited by The Iron and Steel Institute of Japan, published by Maruzen Co., Ltd. in 1979 (2nd Ed., 3rd Issue)

Non-patent document 2: "The Physical Metallurgy of Steels", W. C. Leslie, supervising translation by N. Koda, published by Maruzen Co., Ltd. in 1987 (2nd Issue)

SUMMARY OF THE INVENTION

Problems to be solved by the invention

Various steel materials are conceivable as materials for hollow engine valves, but there are a few of them with cold forgeability. Assume, for example, that a valve umbrella portion is to be formed by cold forging using a material with a high carbon content included in JIS 4311 heat resisting steels. In this case, in order to keep down the incidence rate of defective products, it is necessary to increase the number of steps for drawing, that is, to increase the number of dies. Alternatively, cold forging has to be performed, with an intermediate heat treatment process (such as annealing) being interposed many times between the steps. Anyway, time and labor increase, necessarily rebounding on product prices. Therefore, the development of a method capable of shaping using a material with a high carbon content included in JIS 4311 heat resisting steels, or using other material with poor cold forgeability, without increasing the number of steps, and while minimizing the execution of intermediate heat treatment, has become an impending challenge for the present application to tackle.

Means for Solving the Problems

The present invention has been accomplished in an attempt to solve the above-described problems, and provides the following means for solving the problems (solution means):

<Solution Means 1>

A method for manufacturing a valve umbrella portion of a hollow engine valve having a valve umbrella portion hollow which opens at a side to be welded to a hollow shaft portion or to a shaft end sealing material, the valve umbrella portion hollow being formed with an expanded diameter within an expanded-diameter section of the valve umbrella portion, the maximum inner diameter of the valve umbrella portion hollow being larger than the maximum outer diameter of the hollow shaft portion the method for manufacturing, comprising:

a first step of producing the valve umbrella portion semifinished product from a round solid bar as a raw material; and a second step of converting the valve umbrella portion semifinished product into the valve umbrella portion in finished form by hot forging, wherein the first step is adapted to obtain the valve umbrella portion semifinished product which has an expanded-diameter section integral with a body of a cylindrical shape at an end of the body, the maximum outer diameter of the expanded-diameter section being equal to the maximum outer diameter of the expanded-diameter section of the valve umbrella portion as a finished product when an expanded-diameter section side of the valve umbrella portion semifinished product is placed below; and has a cylindrical hollow having an inner diameter equal to the maximum inner diameter of the valve umbrella portion hollow of the finished product, the cylindrical hollow being open at the upper end thereof and being bottomed within the expanded-diameter section at the lower end thereof, and the second step is adapted to subject the valve umbrella portion semifinished product to forging at a temperature within a range of room temperature to 870° C. to draw an upper part of the expanded-diameter section and the body gradually in a plurality of stages in such a manner as to gradually perform drawing by use of dies for pressing the upper part of the expanded-diameter section and the body of the valve umbrella portion semifinished product, a number of the dies being equal to a number of drawing processes, and inner diameters of the dies decreasing little by little as the stages proceed, while holding an entire space itself including works, the dies, and punches at a constant temperature, thereby obtaining the valve umbrella portion as the finished product in which the maximum inner diameter of the valve umbrella portion hollow within the expanded-diameter section is held at the inner diameter of the cylindrical hollow, and the inner diameter of the valve umbrella portion hollow becomes smaller more upwardly.

<Solution Means 2>

A press device for a valve umbrella portion of a hollow engine valve, which can produce a valve umbrella portion of a hollow engine valve by the method for manufacturing according to the solution means 1, wherein the press device used in the second step has a heat insulating wall embracing the works, fixtures for fixing the works, the dies, and fixtures for fixing the dies, as a whole, and can hold an interior of the heat insulating wall in a constant temperature state by the effect of the heat insulating wall.

<Solution Means 3>

A hollow engine valve prepared by welding the valve umbrella portion, which has been produced by the method for manufacturing according to the solution means 1 or by the press device according to the solution means 2, to an end of a shaft end sealing material.

<Solution Means 4>

A hollow engine valve prepared by welding the valve umbrella portion, which has been produced by the method for manufacturing according to the solution means 1 or by the press device according to the solution means 2, to an end of a hollow shaft portion open at both ends, and welding a shaft end sealing material to the other end of the hollow shaft portion.

Effects of the Invention

According to the invention of the solution means 1 of the present invention, the valve umbrella portion semifinished product is subjected to warm forging at room temperature to 870° C., whereby the entire space itself including works, dies, and punches is held at a constant temperature, and the upper part of the expanded-diameter section and the body are gradually drawn in a plurality of stages. Thus, cracks or deformations are drastically decreased. Moreover, without an increase in the number of steps for necking (drawing), or without the necessity of interposing, many times, intermediate heat treatment such as annealing, the valve umbrella portion can be shaped without problems, even with the use of, say, a material with a high carbon content included in JIS 4311 heat resisting steels.

The reason why the shaping of the valve umbrella portion takes place smoothly is nothing but the following: The present invention involves two steps in which the material is once made into the valve umbrella portion semifinished product in the first step, and then it is drawn in the second step to be converted into the valve umbrella portion as a finished product. That is, if the first step of producing the valve umbrella portion semifinished product is lacking, the warm forging at room temperature to 870° C. does not make it possible to carry out the drawing as the second step smoothly. Thus, hot forging at an even higher temperature has to be employed.

According to the invention of the solution means 2 of the present invention, it is disclosed that a press device for drawing to form a valve umbrella portion finished product is configured to have a heat insulating wall embracing works, fixtures for fixing the works, dies, and fixtures for fixing the dies, as a whole, and to be capable of keeping the interior of the heat insulating wall in a constant temperature state by the effect of the heat insulating wall.

In warm forging, what is most problematical is the modification of the structure of the work due to its temperature changes during drawing. That is, if the number of steps for drawing is of the order of one or two, the work preheated to a necessary temperature is drawn by a die or punch incorporating a heater, whereby the work can be processed with little influence by the modification of the work.

With an increase in the number of steps for drawing, for example, to 3 or 4 or more, however, the temperature of the work lowers every time the work is exposed to the air, even when the dies or punches are heated by the heaters. As a result, the modification (hardening) of the metal structure proceeds. If the work is forcibly drawn under unchanged conditions, therefore, cracking or the like occurs in the work, and a finished product cannot be obtained.

Normally, in case drawing is performed in a somewhat large number of steps, it is a frequent practice to interpose, many times, steps for intermediate heat treatment, such as annealing, in the meantime. For the drawing of the valve umbrella portion of the hollow engine valve, around 10 steps, or more steps in some cases, are needed, although one cannot say definitely, because the situation differs depending on the material. Anyway, the number of the steps for intermediate heat treatment increases, and drawing has to be interrupted for each intermediate heat treatment process. Thus, the intermediate process interposing procedure cannot be a realistic manufacturing method. That is, this procedure, if experimental, is acceptable, but is deemed not to have technical contents applicable to line production in an actual plant.

Thus, it becomes necessary to continuously perform drawing in around 10 steps, or more steps in some cases, while minimizing the number of steps for intermediate heat treatment, such as annealing, to be interposed. Of vital importance here is to avoid a temperature fall of the work. A constant temperature is achievable if the heater is incorporated in or annexed to the die or punch. For the work for which the heater is not mountable, on the other hand, a temperature fall at the instant of exposure to the air is unavoidable. To solve this problem, the entire space itself including the works, dies and punches needs to be kept at a constant temperature.

The invention of the solution means 2 of the present invention discloses technical contents which allow the entire space to be maintained in a constant temperature atmosphere. Because of the technical contents, the constant temperature state in the drawing of the work is held in the ideal form. Consequently, the temperature fall of the work is avoided during drawing of the work, and drawing in the plural steps can be performed smoothly, without the need to carry out intermediate heat treatment many times.

According to the invention of the solution means 3 or the solution means 4 of the present invention, there can be obtained a hollow engine valve as a finished product having the valve umbrella portion obtained by the invention of the solution means 1 or the solution means 2 of the present invention.

The grounds for the numerical limitation on the temperature range in the second step described in the solution means 1 are as follows: There are various theories on the definition of the temperature range of warm forging, and no established theory has been presented. In the present invention, a temperature range "equal to or lower than the recrystallization temperature of a steel material", which is considered to be the most common as a temperature range for warm forging, is taken as "the temperature range for warm forging". The meaning of "common", as referred to here, is that "can be applied most widely in various steel materials". Thus, it goes without saying that as the material is restricted, this temperature range can be limited to an even narrower range.

Based on the above concept, there is no lower limit on the temperature range of "warm forging". In the actual job site, however, it is a rare practice to forge a material while cooling it. Thus, the lower limit of the temperature range is set at "room temperature". The definition of "room temperature" is also considered variously, but in the present invention, "room temperature" is taken to mean 10° C. to 30° C. according to common knowledge. The lower limit in the actual operation is assumed to be around 20° C.

Next, the upper limit of the temperature range for "warm forging" is set at 870° C. based on the description of FIG. 2.16 on page 48 of the aforementioned non-patent document 1. That is, the recrystallization temperature is not a specific temperature, but fluctuates with conditions. FIG. 2.16 on page 48 of the non-patent document 1 states that in the case of soft-iron, there can be a recrystallization temperature of up to 870° C. depending on conditions. Thus, this value has been adopted as the upper limit of the temperature range.

In connection with the recrystallization temperature of iron, the aforementioned non-patent document 2 describes on page 138 that the recrystallization temperature varies (rises) if an additive element is contained in iron. The heat resisting steel, one of the materials in the present invention, contains nickel (contained in almost all of austenitic heat resisting steels), molybdenum (contained in SUH 38), and chromium (contained in all of heat resisting steels), which act to raise the recrystallization temperature. From the data described on page 138 of the aforementioned non-patent document 2, it can be expected that the recrystallization temperature is highly likely to be at least 700° C., although it may vary according to the proportion of an alloying element added to iron.

In the present invention, the term "valve umbrella portion as a finished product" or the term "valve umbrella portion in finished form" is used. These terms refer to a valve umbrella portion in the following states:

1) The valve umbrella portion has reached a state in which the outer diameter of the expanded-diameter section does not change any more.

2) The valve umbrella portion has reached a state in which the maximum inner diameter of the hollow does not change any more.

3) The valve umbrella portion has reached a state in which the outer diameter of the end of the body agrees with the outer diameter of the shaft end sealing material or the hollow shaft portion.

The valve umbrella portion in the above three states is called "valve umbrella portion as a finished product" or "valve umbrella portion in finished form".

Thus, one is free, for example, to stamp a surface of the expanded-diameter section of the valve umbrella portion in finished form in a flat state, or form a concavity there by hot forging. Such an act is essentially processing which is applied later to the "valve umbrella portion as a finished product" or the "valve umbrella portion in finished form" in the present invention. Needless to say, any similar processings, which are performed later using the "valve umbrella portion as a finished product" or the "valve umbrella portion in finished form" in the present invention, are all included in the scope of the present invention, if they employ the method of the present invention in working the valve umbrella portion in the aforementioned three states.

The method of the present invention also aims to minimize processes for "annealing". Hence, it is only natural, in view of the above gist, that the scope of the present invention does not exclude a method of interposing one or two intermediate annealing steps in the method of the present invention. That is, in a case where, for example, the number of steps in a rotary press device is too large, the second step is divided into a former half and a latter half to decrease the number of the processes by one, and a step of reheating, i.e., annealing, of the material is interposed between the former half and the latter half. This is a matter-of-course request based on the technical contents. All such methods are included, without doubt, in the scope of the present invention.

BRIEF DESCRIPTION OF THE DRAWINGS

FIG. 6(*b*) is a vertical sectional view of a valve umbrella portion as a finished product obtained in the second step in the manufacturing method of Embodiment 1 of the present invention.

FIG. 9 (*b*) is a vertical sectional view of another example of the hollow engine valve obtained in the manufacturing method of Embodiment 1 of the present invention.

MODE FOR CARRYING OUT THE INVENTION

The best mode for carrying out the present invention will be described in detail below by reference to the accompanying drawings.

Embodiment 1

Figure 9A:
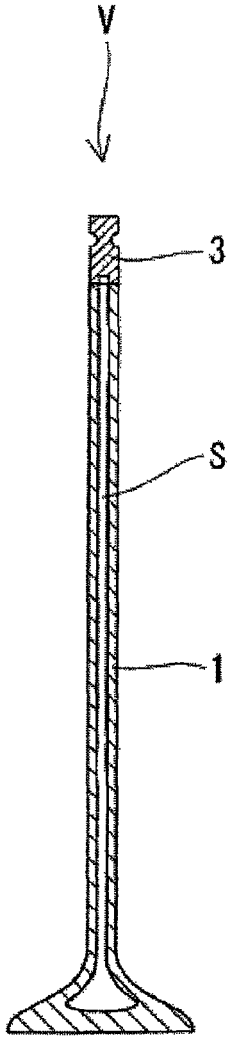
FIG. 9(*a*) is a vertical sectional view of an example of a hollow engine valve obtained in the manufacturing method of Embodiment 1 of the present invention.

As Embodiment 1 of the present invention, a method for manufacturing a valve umbrella portion 1, and a hollow engine valve V having the valve umbrella portion 1 will be described in detail as follows: The hollow engine valve V is composed of the valve umbrella portion 1, and a shaft end sealing material 3, as shown in FIG. 9*a*. That is, the hollow engine valve V is of a structure in which the shaft end sealing material 3 is welded to an end of the valve umbrella portion 1, and a hollow S is provided inside the valve umbrella portion 1. In the hollow S, when the hollow engine valve V is used as an exhaust valve, sodium (not shown) is sealed up. When the hollow engine valve V is not used as an exhaust valve, sodium is not sealed up in the hollow S.

Figure 9B:
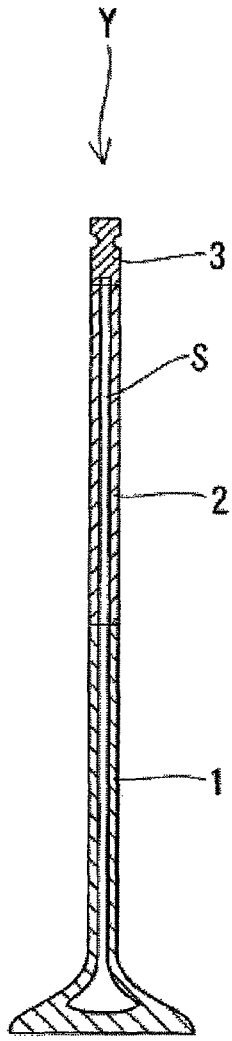

A hollow engine valve Y shown in FIG. 9*b* represents an example in which a hollow shaft portion 2 is welded to a valve umbrella portion 1, and a shaft end sealing material 3 is further welded to the hollow shaft portion 2. Inside the hollow engine valve Y, a hollow S is similarly provided. In the hollow S, when the hollow engine valve Y is used as an exhaust valve, sodium (not shown) is sealed up. When the hollow engine valve Y is not used as an exhaust valve, sodium is not sealed up in the hollow S.

As the hollow shaft portion 2 of the hollow engine valve Y, an electric welded tube prepared by welding together the ends of a steel sheet rolled up, or a seamless pipe without seams can be used. Any welding method is available when welding the respective members, but friction welding, for example, can be used.

Concrete names for the material for the valve umbrella portion 1 are as follows: When the hollow engine valve V or Y of Embodiment 1 is used as an exhaust valve, a material with high resistance to heat, such as NCF 47W or SUH 35 or Inconel 751, is used for the valve umbrella portion 1. A material with the second highest resistance to heat, for example, SUS 304, SUS 430 or SUH 11, is used for the hollow shaft portion 2 (only in Y). For the shaft end sealing material 3, a material with slightly poor resistance to heat, such as SUH 11, may be used. When the engine valve V or Y is not used as an exhaust valve, on the other hand, a material with so high resistance to heat need not be used for any of the valve umbrella portion 1, the hollow shaft portion 2, and the shaft end sealing material 3.

The hollow engine valve V or Y obtained by the manufacturing method of Embodiment 1 of the present invention is as described above. The manufacturing method for the valve umbrella portion 1, which serves as the core for Embodiment 1 of the present invention, will be described in detail below.

<First Step>

Figure 6A:
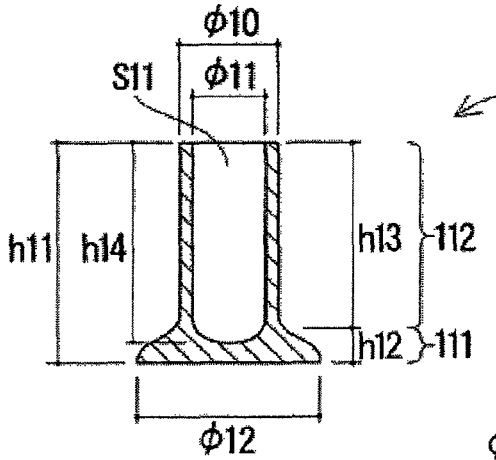
FIG. 6(*a*) is a vertical sectional view of a valve umbrella portion semifinished product obtained in the first step in the manufacturing method of Embodiment 1 of the present invention.

FIG. 6*a* shows, in a vertical sectional view, the valve umbrella portion 1 in semifinished form (a semifinished product 11) which is obtained in the first step of Embodiment 1 of the present invention. The semifinished product 11 is formed, with a disk-shaped expanded-diameter section 111 and a cylindrical body 112 as an integral unit. A lower end part of the body 112 is continuously connected to the upper end of the expanded-diameter section 111, and a connecting part gently curves, as shown in FIG. 6*a*. Inside the semifinished product 11, a cylindrical hollow S11 having a bottomed lower end is formed. The upper end of the hollow S11 opens at an upper surface of the body 112, and its lower end is bottomed within the expanded-diameter section 111.

Figure 6B:
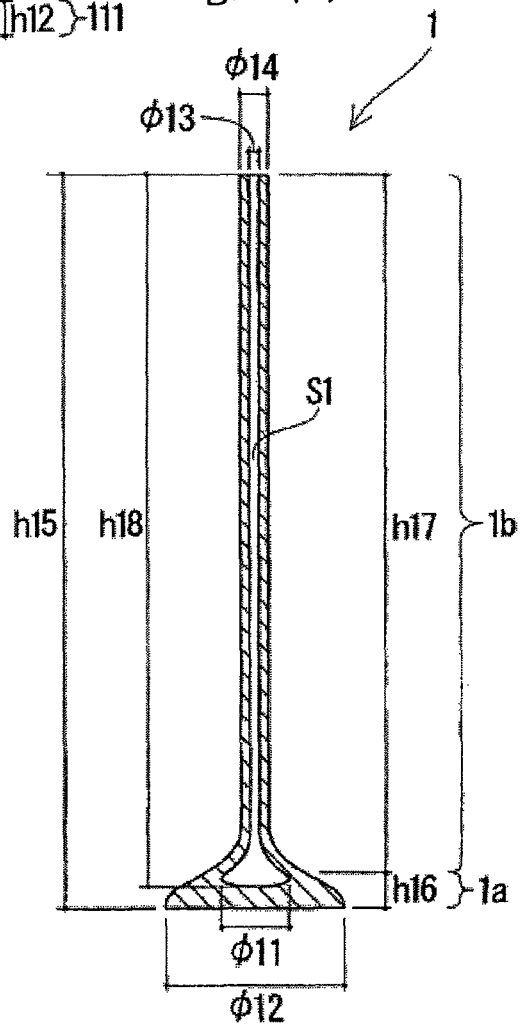

In a second step of Embodiment 1 of the present invention, an upper part of the expanded-diameter section 111 and the whole of the body 112 of the semifinished product 11 in FIG. 6*a* are subjected to drawing (necking) by warm forging to obtain the valve umbrella portion 1 in finished form as shown in FIG. 6*b*. In FIG. 6*b*, 1*a* denotes an expanded-diameter section, and 1*b* denotes a body. In the valve umbrella portion 1 as a finished product, it is difficult to determine the boundary between the expanded-diameter section 1*a* and the body 1*b*. In FIG. 6*b*, however, the expanded-diameter section 1*a* and the body 1*b* are separated at a site of the contour of the sectional view where the curvature of the curve becomes sharp. S1 denotes a cylindrical hollow bottomed at its lower end, the upper end of the hollow S1 opens at an upper surface of the body 1*b*, and the lower end of the hollow S1 is bottomed within the expanded-diameter section 1*a*.

In FIG. 6*a*, h11 denotes the height of the entire semifinished product 11; h12, the height of the expanded-diameter section 111; h13, the height of the body 112; h14, the height (depth) of the hollow S11; ϕ 10, the outer diameter of the body 112; ϕ 12, the maximum outer diameter of the expanded-diameter section 111; and ϕ 11, the inner diameter of the hollow S11. In FIG. 6*b*, h15 denotes the height of the entire valve umbrella portion 1 as a finished product; h16, the height of the expanded-diameter section 1*a*; h17, the height of the body 1*b*; h18, the height (depth) of the hollow S1; ϕ 14, the outer diameter of an upper end part of the body 1*b*; ϕ 12, the maximum outer diameter of the expanded-diameter section 1*a*; ϕ 11, the maximum inner diameter of the hollow S1; and ϕ 13, the inner diameter of an upper end part of the hollow S1.

The height h15 of the entire valve umbrella portion 1 as a finished product is larger than the height h11 of the entire semifinished product 11 (h11<h15); the height (depth) h18 of the hollow S1 is larger than the height (depth) h14 of the hollow S11 (h14<h18); the height h12 of the expanded-diameter section 111 is nearly equal to the height h16 of the expanded-diameter section 1*a* (h12≈h16); the height h17 of the body 1*b* is larger than the height h13 of the body 112 (h13<h17); the maximum outer diameter of the expanded-diameter section 111 is the same as the maximum outer diameter of the expanded-diameter section 1*a* (both are ϕ 12); the outer diameter ϕ 10 of the upper end part of the body 112 is larger than the outer diameter ϕ 14 of the upper end part of the body 1*b* (ϕ 14<ϕ 10); the inner diameter of the hollow S11 is the same as the maximum inner diameter of the hollow S1 (both are ϕ 11); and the inner diameter ϕ 11 of the hollow S11 is larger than the inner diameter ϕ 13 of the upper end part of the hollow S1 (ϕ 13<ϕ 11).

Figure 7C:
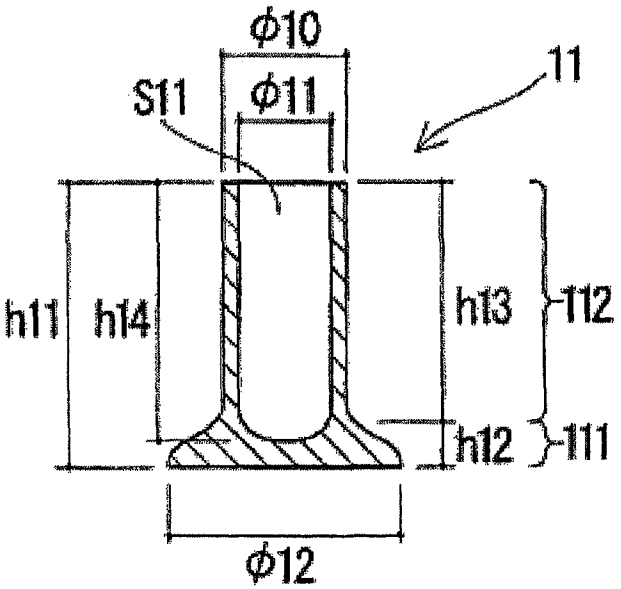
FIGS. 7(*a*) to 7(*c*) are explanation drawings for illustrating a first method for the first step in the manufacturing method of Embodiment 1 of the present invention.
Figure 7B:
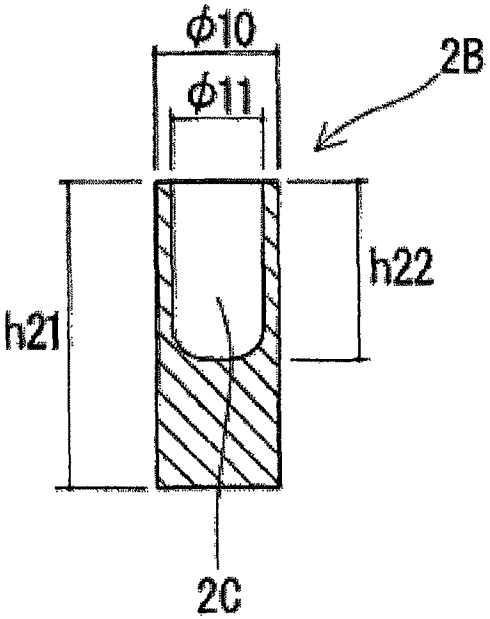
Figure 7A:
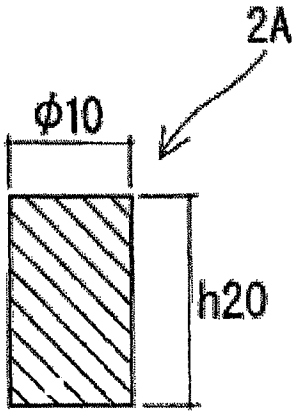

FIGS. 7(*a*) to 7(*c*) show a first method for obtaining the semifinished product 11. As shown in FIG. 7*a*, a round solid bar 2A composed of a suitable material is rendered ready for use. In Embodiment 1, SUH 35 is used as a material, on the assumption that the engine valve V or Y is used as an exhaust valve. The outer diameter of the round solid bar 2A is ϕ 10 which is the same as the outer diameter of the body 112 of the semifinished product 11, and its height h20 is smaller than the height h11 of the semifinished product 11 (h20<h11).

A hollow 2C is formed in an upper surface of the round solid bar 2A by a punch to make a tumbler-shaped intermediate member 2B (FIG. 7*b*). In the present embodiment, the hollow 2C has a height (depth) h22 which is about a half of the height h21 of the entire intermediate member 2B. The outer diameter of the intermediate member 2B is rendered identical with the outer diameter ϕ 10 of the round solid bar 2A. As a result, the height h21 of the intermediate member 2B becomes larger than the height h20 of the round solid bar 2A (h20<h21). The inner diameter of the hollow 2C is set to be the same as the inner diameter ϕ 11 of the hollow S11 of the semifinished product 11 (FIG. 7*c*).

Then, a lower part of the intermediate member 2B is shaped by forging to make an expanded-diameter section 111. On this occasion, the type of forging does not matter. That is, any of cold forging, warm forging, and hot forging may be used. Since this step is an intermediate step, such accuracy as will be required in a second step to be described later is not required. However, the following three conditions are important, i.e., that the outer diameter of the upper part of the intermediate member 2B be held at the outer diameter ϕ 10 of the body of the semifinished product 11, that the inner diameter of the hollow 2C be held at the inner diameter ϕ 11 of the hollow S11 of the semifinished product 11, and that when the lower part of the intermediate member 2B is formed into the expanded-diameter section 111, its maximum outer diameter be rendered the maximum outer diameter ϕ 12 of the expanded-diameter section 111 of the semifinished product 11. During this process, the hollow 2C (height h22) is slightly deepened to become the hollow S11 of the height (depth) h14. In this manner, the semifinished product 11 (FIG. 7*c*) is obtained from the round solid bar 2A (FIG. 7*a*) by way of the intermediate member 2B (FIG. 7*b*).

Figure 8C:
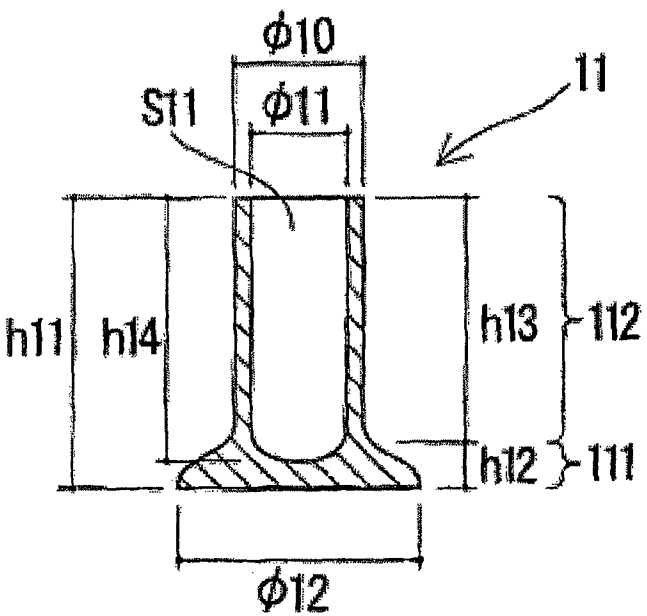
FIGS. 8(*a*) to 8(*c*) are explanation drawings for illustrating a second method for the first step in the manufacturing method of Embodiment 1 of the present invention.
Figure 8B:
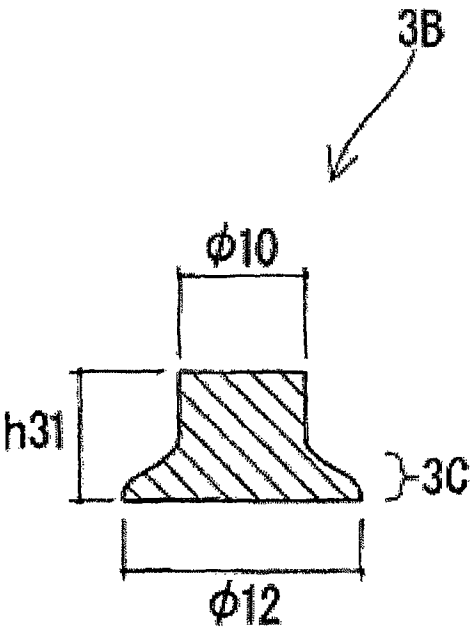
Figure 8A:
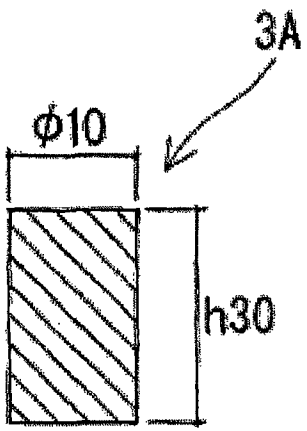

FIGS. 8(*a*) to 8(*c*) show a second method for obtaining the semifinished product 11. As shown in FIG. 8*a*, a round solid bar 3A composed of a material selected from suitable materials is rendered ready for use. In Embodiment 1, SUH 35 is used as the material, on the assumption that the engine valve V or Y is used as an exhaust valve. The outer diameter of the round solid bar 3A is ϕ 10 which is the same as the outer diameter of the body 112 of the semifinished product 11, and its height h30 is smaller than the height h11 of the semifinished product 11 (h30<h11). The height h30 is equal to the height h20 of the aforementioned round solid bar 2A (h30=h20).

A lower part of the round solid bar 3A is shaped by forging to make a hat-shaped solid intermediate member 3B having an expanded-diameter section 3C (FIG. 8*b*). On this occasion, the type of forging does not matter. That is, any of cold forging, warm forging, and hot forging may be used. Since this step is an intermediate step, such accuracy as will be required in the second step to be described later is not required. However, the following two conditions are important, i.e., that the outer diameter of an upper part of the intermediate member 3B be held at the outer diameter ϕ 10 of the body of the semifinished product 11, and that when a lower part of the intermediate member 3B is formed into the expanded-diameter section 3C, the maximum outer diameter of the expanded-diameter section 3C be rendered the maximum outer diameter ϕ 12 of the expanded-diameter section 111 of the semifinished product 11. During this process, the height h31 of the intermediate member 3B is slightly decreased. That is, h31<h30.

Then, a hollow S11 with a height (depth) h14 and an inner diameter ϕ 11 is formed in an upper surface of the intermediate member 3B by a punch. By this process, an upper part of the intermediate member 3B is stretched to become a body 112 with a height h13 (FIG. 8*c*). In this manner, a semifinished product 11 (FIG. 8*c*) is obtained from the round solid bar 3A (FIG. 8*a*) by way of the intermediate member 3B (FIG. 8*b*). On this occasion, the following two points are important: the outer diameter of the body 112 is held at ϕ 10, and the maximum outer diameter of the expanded-diameter section 111 is held at ϕ 12.

<Second Step>

Figure 1:
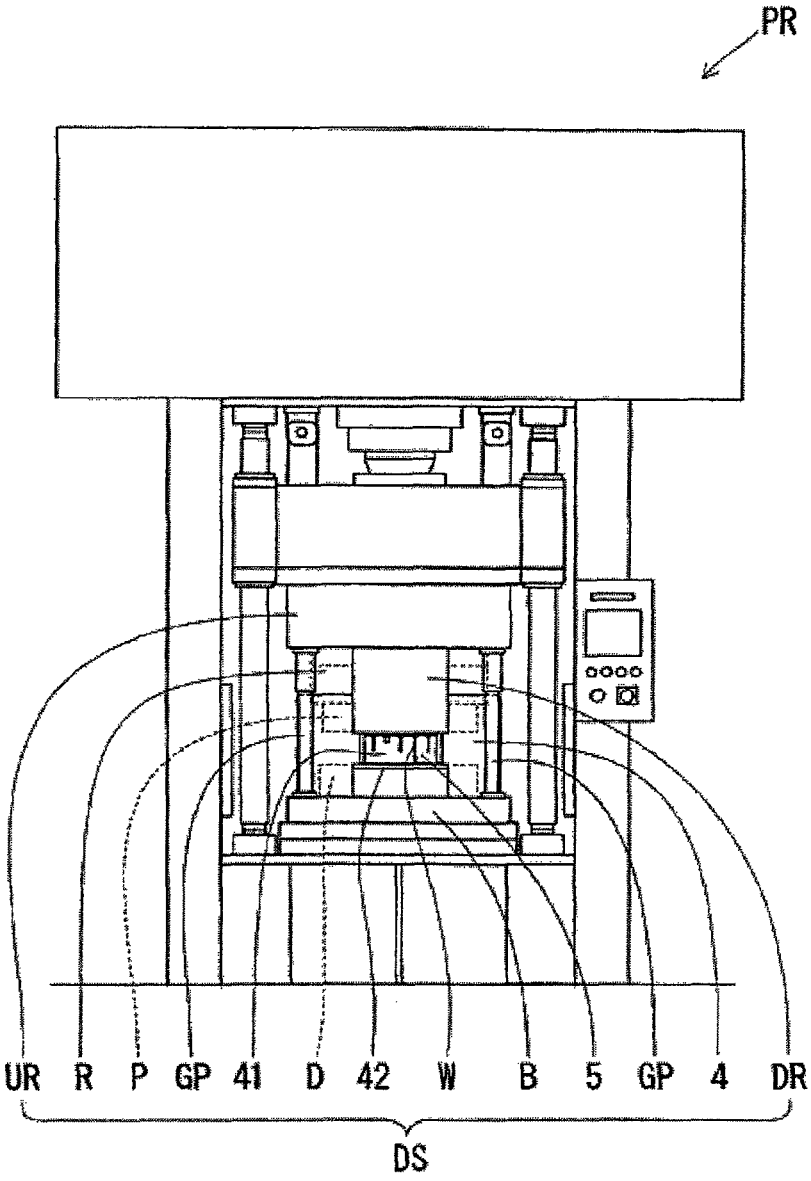
FIG. 1 is a front view of a press device used in the second step in the manufacturing method of Embodiment 1 of the present invention.

Next, the process of warm forging in the second step will be described in detail by reference to FIG. 1 to FIGS. 5(*a*) to 5(*d*). FIG. 1 shows a press device PR used in the second step. The press device PR is a rotary press device, and its constitution is publicly known. Thus, its constitution will be described in detail merely in relation to a die set (DS) which has a structure characteristic of Embodiment 1 of the present invention.

The die set DS is composed of a plurality of upper punches P from which works W hang; a plurality of dies D where the works W are inserted and shaped; a ram R and an upper ram UR for pressing the plurality of upper punches P; a press bed B where the plurality of dies D are fixed; and four guide posts GP which expand and contract. Each time the ram R rotates through a constant angle, the corresponding positions of the plurality of upper punches P and the plurality of dies D shift one by one. In this case, it does not matter whether the ram R is rotated clockwise or rotated counterclockwise in plan view, but in Embodiment 1, the ram R is rotated clockwise when viewed in plan.

That is, the punch P inserts the work W into the die D and shapes it there. When the ram R ascends, the ram R rotates clockwise, in plan view, through a constant angle and stops. Thus, the punch P is located directly above the next die D. In this state, the punch P inserts the work W into the next die D and shapes it there. When the ram R ascends, the ram R rotates clockwise through a constant angle in plan view and stops. The rotary press device, which performs shaping in this manner, is a publicly known technology, so that an explanation for the rotating mechanism will not be offered any more. The plurality of upper punches P hanging the works W correspond to "fixtures for fixing the works" described in the solution means 2. The plurality of dies D include "fixtures for fixing the dies" described in the solution means 2.

The plurality of dies D and the plurality of upper punches P incorporate heaters (not shown), which can hold the plurality of dies D and the plurality of upper punches P in a constant temperature state at any temperature between room temperature (10° C. to 30° C.) and 870° C. Since the dies and punches equipped with the heaters are publicly known, a detailed explanation for them is omitted. The reason for the limitation on the temperature range is as already presented herein.

Figure 3:
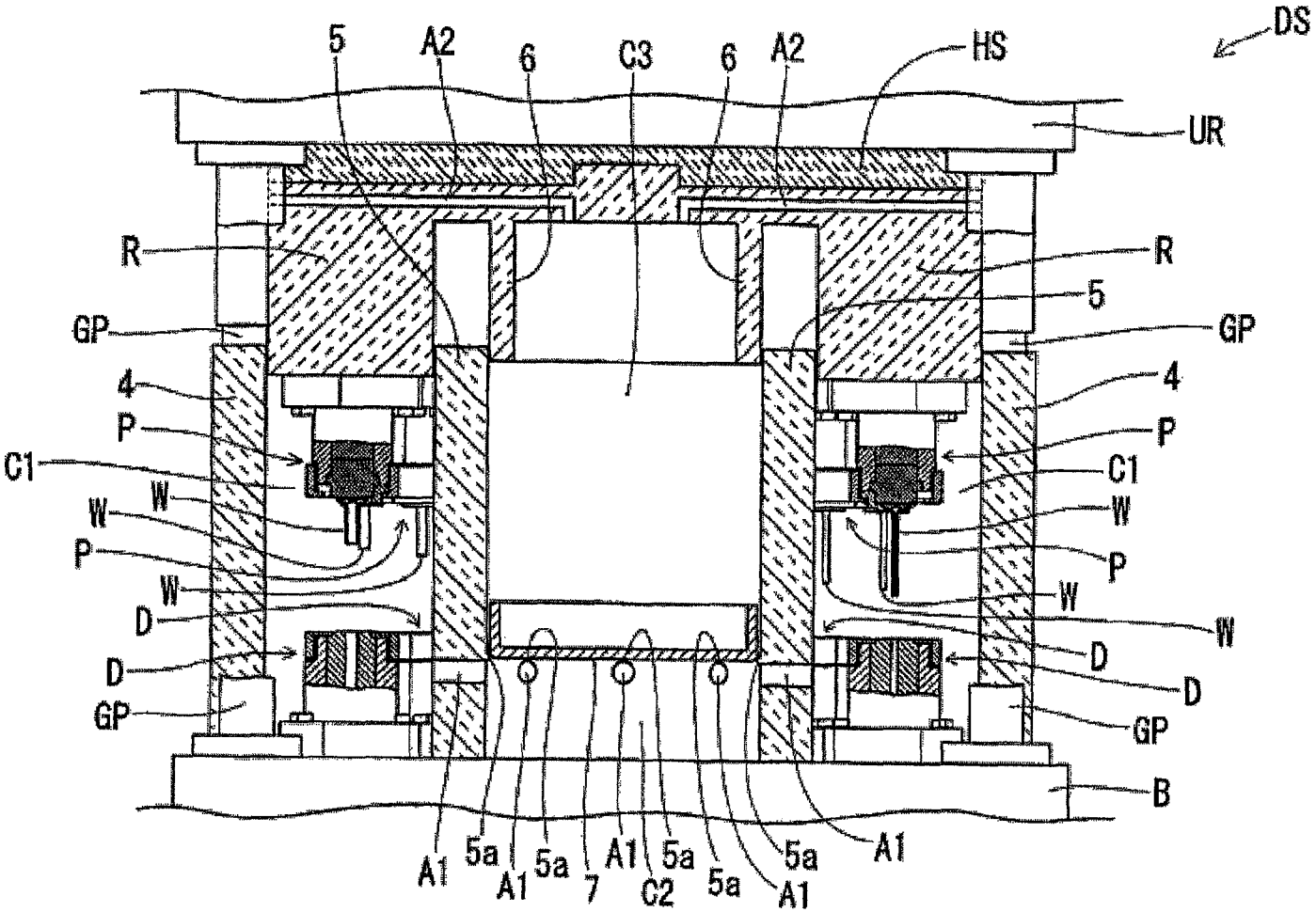
FIG. 3 is a longitudinal sectional view of the press device used in the second step in the manufacturing method of Embodiment 1 of the present invention, in which a part of the die set is omitted.

The whole of the plurality of dies D and the plurality of upper punches P is surrounded by an outer cylinder 4 and an inner cylinder 5 comprising a heat insulating material (see FIG. 3). That is, a double cylinder composed of the outer cylinder 4 and the inner cylinder 5 forms a doughnut-shaped space C1, and the plurality of dies D and the plurality of upper punches P, as a whole, are embraced within the space C1. A part or all of the ram R is formed from a heat insulating material, and a part of the heat insulating material portion of the ram R is configured in a cylindrical shape as a shielding tube 6 positioned inwardly of the inner cylinder 5. The outer cylinder 4, the inner cylinder 5, and the shielding tube 6 are configured to correspond to "heat insulating wall" described in the solution means 2.

A heat insulating layer HS comprising a heat insulating material is interposed between the ram R and the upper ram UR. A heat insulating layer is also provided between the plurality of dies D and the press bed B, although this is not shown. These heat insulating layers also correspond to the "heat insulating wall" described in the solution means 2.

A dish-shaped float 7 is provided in a lifted state in a space C2 inside the inner cylinder 5. The float 7 has a lowermost position determined by a plurality of protrusions 5*a* provided on the inner cylinder 5. A plurality of airways A1 are bored in the inner cylinder 5, and the space C1 and the space C2 are in communication by the plurality of airways A1. Moreover, a plurality of airways A2 are bored in the ram R as well, and a space C3 above the float 7 and the outside space are brought into communication by the plurality of airways A2.

Figure 2:
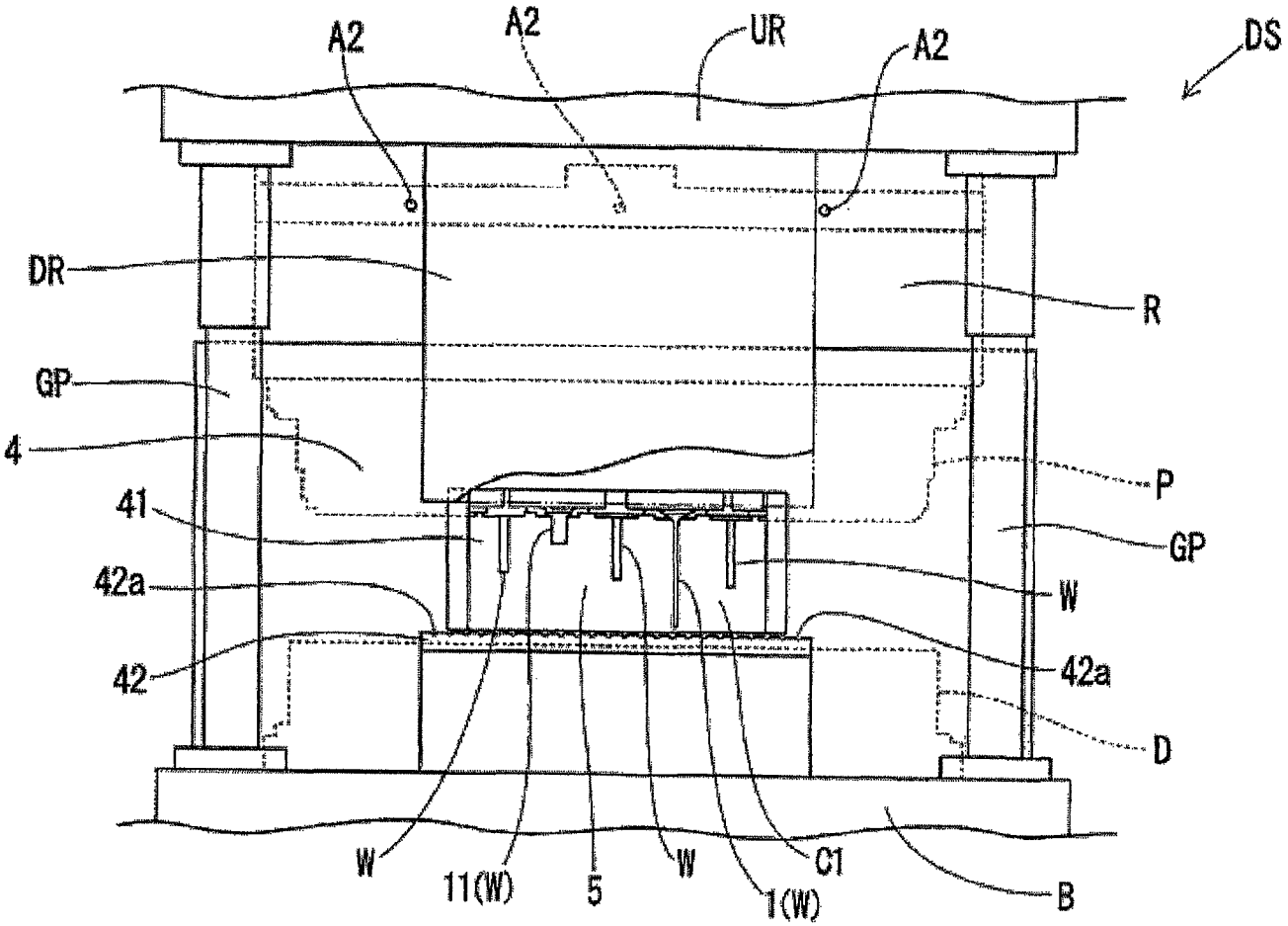
FIG. 2 is the front view of the press device used in the second step in the manufacturing method of Embodiment 1 of the present invention, in which a part of a die set is omitted.

A rectangular window portion 41 is formed in a front part of the outer cylinder 4 by boring (see FIG. 2). A door DR is mounted on a front part of the ram R, and is adapted to shut the window portion 41 of the outer cylinder 4 as the ram R is lowered. The numeral 42 denotes an air curtain device having a plurality of blowoff ports 42*a* bored and arranged parallel in an upper part thereof, and the plurality of blowoff ports 42*a* are disposed parallel along the lower side of the window portion 41.

Next, the actions of the die set DS will be described. The press device PR is used in the second step in the manufacturing method of Embodiment 1 of the present invention. Thus, an explanation for the actions of the die set DS serves, unchanged, as an explanation for the second step in the manufacturing method of Embodiment 1 of the present invention.

Figures 4A, 4B, 4C, 4D:
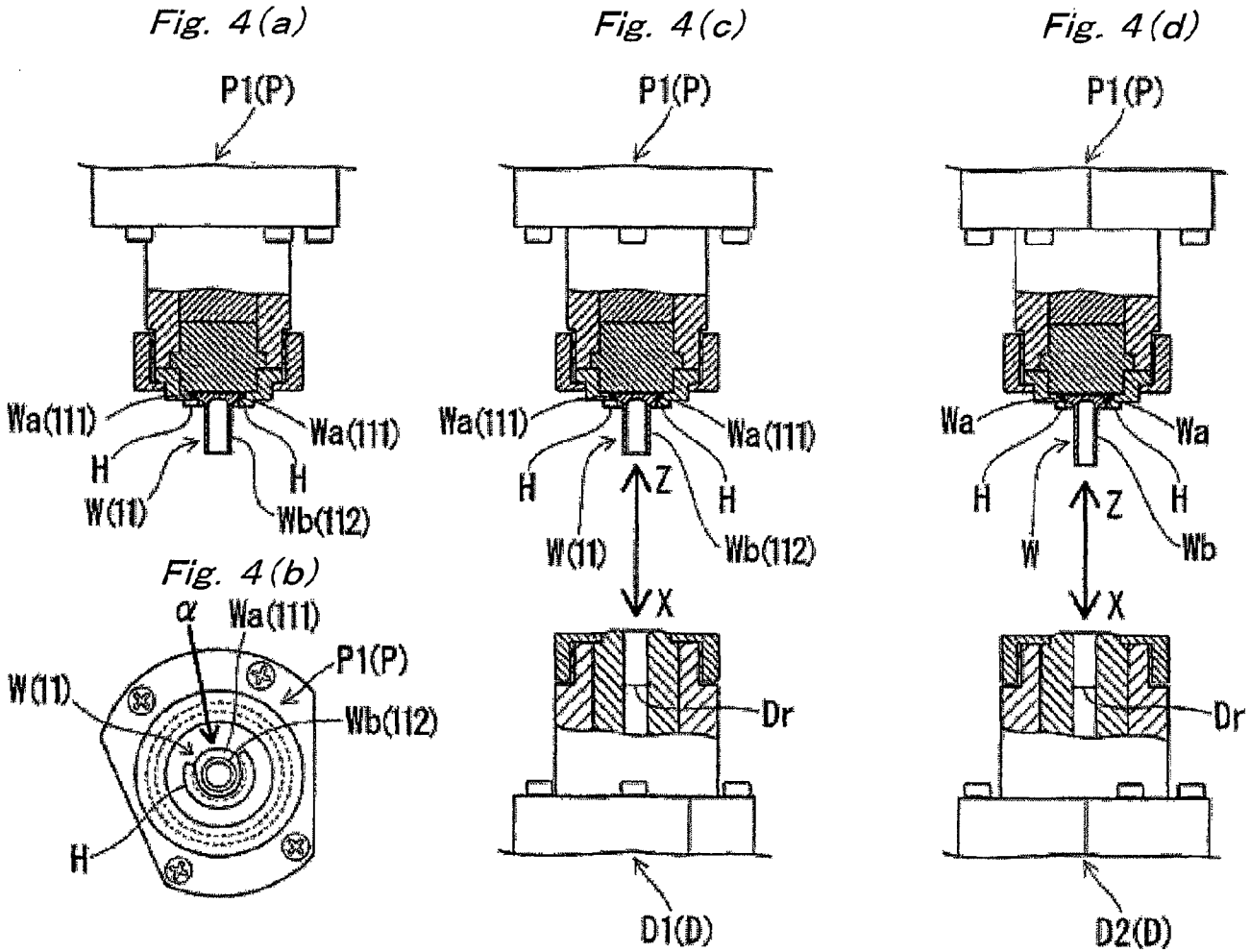
FIGS. 4(*a*) to 4(*d*) are explanation drawings for illustrating the second step in the manufacturing method of Embodiment 1 of the present invention.

The semifinished product 11 for the valve umbrella portion is carried into the die set DS by a carry-in device (not shown). This carry-in act is performed through the window portion 41. On this occasion, the ram R is in an ascending state as shown in FIG. 2. The semifinished product 11 is carried, as the work W, into the space C1, with the expanded-diameter section 111 directed upward (direction a in FIG. 4*b*), and is suspended from and fixed to a hanger H (see FIGS. 4*a*, 4*b*) of an upper punch P1 (P) in the shape of a horseshoe in bottom view. The hanger H is apart of the "fixtures for fixing the works" described in the solution means 2. FIG. 4*b* is a bottom view of the upper punch P1 (P). In a state where the work W (semifinished product 11) has been carried in, the die D is not present below the upper punch P1 (P).

When the work W (semifinished product 11) has been completely suspended from and fixed to the hanger H of the upper punch P1 (P), the carry-in device (not shown) recedes from the window portion 41, and the ram R rotates through a constant angle clockwise in plan view. At this time, the center of the work W (semifinished product 11) lies directly above the center of the die D1, and the rotation of the ram R is stopped here (see FIG. 4*c*).

Then, the ram R lowers (direction X in FIG. 4*c*). When the ram R descends, the work W (semifinished product 11) is inserted into the die D1 (D), whereupon first drawing is performed. Then, the ram R ascends (direction Z in FIG. 4*c*). Further, the ram R rotates through a constant angle clockwise in plan view and stops directly above a die D2 (D) (see FIG. 4*d*). Then, the ram R lowers (direction X), and the work W undergoes second drawing by the die D2 (D).

Figures 5A, 5B, 5C, 5D:
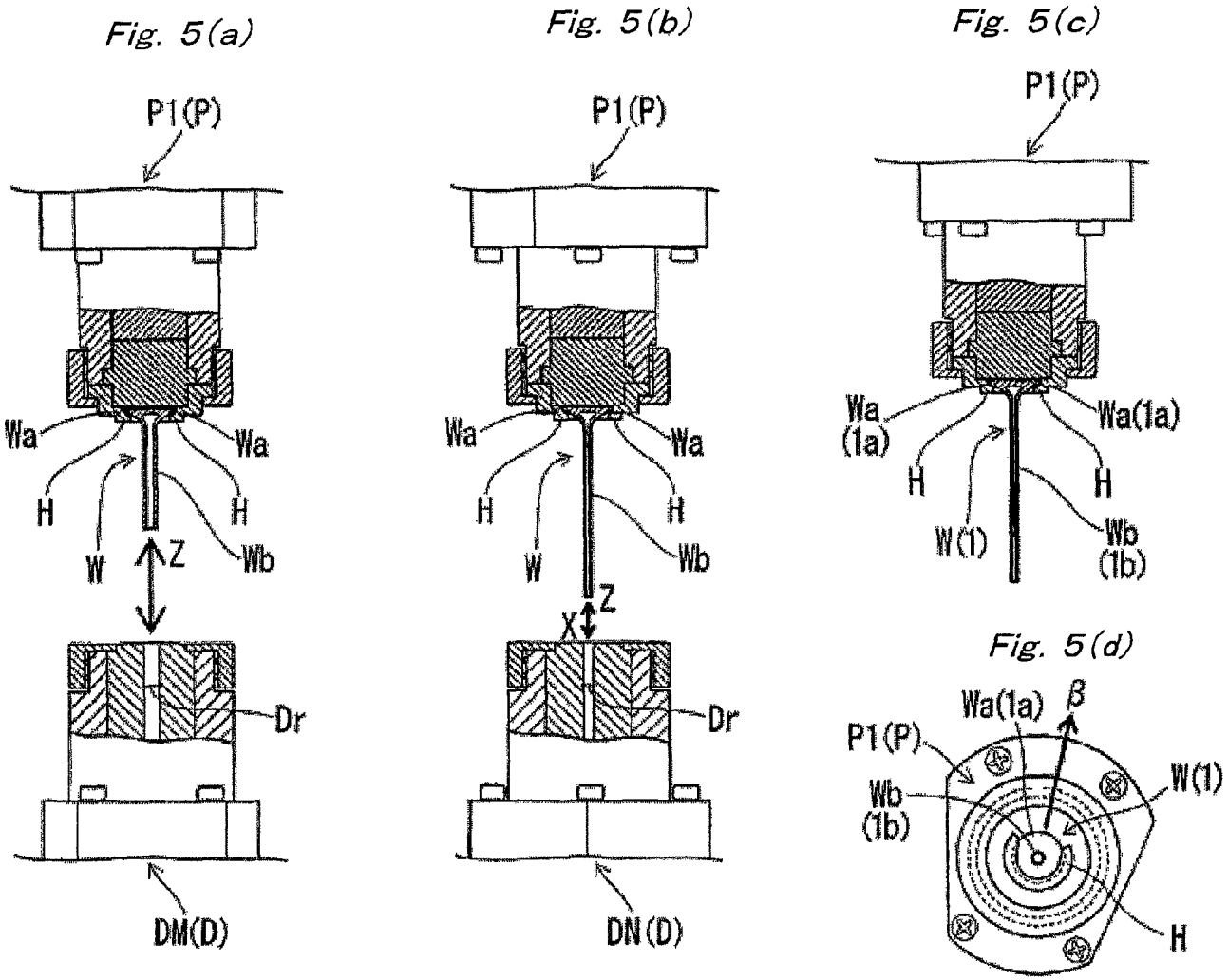
FIGS. 5(*a*) to 5(*d*) are explanation drawings for illustrating the second step in the manufacturing method of Embodiment 1 of the present invention.

In the above-described manner, the work W is subjected to drawing until it reaches a die DN (D) in FIG. 5*b*, whereby it is shaped as a valve umbrella portion 1 as a finished product (see FIG. 5*c*). FIG. 5*a* shows a state during the process where the work W is located directly above a die DM (M<N), and immediately before the work W is subjected to drawing by the die DM (M<N). When the work W is converted into the valve umbrella portion 1 in finished form after drawing in FIG. 5*b* and the ram R rotates through a constant angle clockwise in plan view, the work W is located just behind the window portion 41 (see FIGS. 5*c*, 5*d*). The carry-in device (not shown) is inserted there to detach the work W (valve umbrella portion 1) from the hanger H (direction β in FIG. 5*d*) and carry it out of the window portion 41. FIG. 5*d* is a bottom view of the upper punch P1 (P) at the time of carrying-out. In this state, the corresponding die D is not present below. The carrying-in (FIGS. 4*a*, 4*b*) of the work W (semifinished product 11) and the carrying-out (FIGS. 5*c*, 5*d*) of the work W (valve umbrella portion 1) are carried out at the same time. FIGS. 4 (*a*) to 4 (*d*) and FIGS. 5 (*a*) to 5 (*d*) show a state where the semifinished product 11 for the valve umbrella portion (i.e., work W) is drawn by the dies D1 to DN of the inner diameter Dr gradually decreasing each time the drawing step is performed, whereby it is turned into the valve umbrella portion 1 in finished form (work W). If it is assumed that the number of the dies D is N, there are (N+2) of the upper punches P. When the ram R rotates through a constant angle clockwise in plan view, the next upper punch P is located just behind the window portion 41, and a new work W is suspended therefrom and fixed thereto. Thus, every time the ram R rotates through a constant angle clockwise in plan view, the work W is inserted into and shaped by each of the plurality of dies D. After the first semifinished product 11 (work W) is formed into the valve umbrella portion 1 in finished form (work W), it follows that each time the ram R rotates through a constant angle clockwise in plan view, one valve umbrella portion 1 in finished form is prepared. From the viewpoint of the life of the die, there can be a method by which the semifinished product 11 (work W) is suspended from and fixed to each alternate one of the plurality of upper punches P.

It should be noted here that the expanded-diameter section Wa of the work W remains suspended from the hanger H always from the beginning to the end. That is, most of the expanded-diameter section Wa of the work W is not inserted into any of the dies D1 to DN, and thus does not undergo drawing. As seen here, drawing focuses on the body Wb, while scarcely deforming the expanded-diameter section Wa of the work W, thus making smooth drawing possible.

That is, once the semifinished product 11 as shown in FIG. 6*a* is shaped first (first step), there is virtually no need to deform the expanded-diameter section Wa of the work W in the subsequent second step, and drawing can be carried out, with this section being suspended from the hanger H. Thus, the first step and the second step can be coupled very rationally, and finally, it is possible to obtain the valve umbrella portion 1 in finished form having the hollow S held in a sufficiently diameter-expanded state within the expanded-diameter section 1*a*.

In FIG. 3, when the ram R descends, air within the space C1 is compressed, but since the plurality of airways A1 are provided in the inner cylinder 5, compressed air passes through the plural airways A1 and flows into the space C2 surrounded by the inner cylinder 5. As a result, the air pressure in the space C2 becomes high to push up the float 7, so that the float 7 ascends. The raised float 7 compresses the space C3 lying above, and air compressed there passes through the plurality of airways A2 provided in the ram R and is discharged to the outside of the apparatus.

When the ram R ascends, a process opposite to the above-mentioned process occurs. That is, the air pressure in the space C1 lowers, whereupon air in the space C2 flows in through the plurality of airways A1. When the air pressure in the space C2 drops, the float 7 lowers, and the air pressure in the space C3 falls. When the air pressure in the space C3 drops, air flows into the space C3 from the outside of the press device through the plurality of airways A2. In accordance with the ascent and descent of the ram, the above-described processes are repeated.

Heaters (not shown) are built in the plurality of upper punches P and the plurality of dies D, and the plurality of upper punches P and the plurality of dies D are set to be in a constant temperature state at any temperature in a temperature range between room temperature (10° C. to 30° C.) and 870° C. If the material for the work W is SUH 35, it is possible, as an example, to set the plurality of upper punches P and the plurality of dies D in a constant temperature state at a temperature of the order of 400° C. Moreover, the work W is also heated beforehand to 400° C. using an induction heater or the like (not shown) and, in this state, is inserted into the space C1 through the window portion 41. Needless to say, the work W can also be heated to any temperature in the temperature range between room temperature (10° C. to 30° C.) and 870° C.

The plurality of upper punches P, the plurality of dies D, and the works W are all placed in the same temperature state, and the whole of them is surrounded by the outer cylinder 4 and the inner cylinder 5. Within the space C1, therefore, the plurality of upper punches P, the plurality of dies D, the works W, and air in this space can all be held in the same temperature atmosphere. Air in the space C1 communicates with air in the space C2 via the plurality of airways A1, but does not leak outside the space C2 because of the shielding effect of the float 7. Thus, the constant temperature atmosphere in the space C1 can be maintained, although warmed air moves between the space C1 and the space C2.

Moreover, the space C3 communicates with the outside space via the plurality of airways A2, but the space C3 and the space C2 are shielded and cut off from each other by the shielding effect of the float 7. Thus, cold air in the outside space does not flow into the space C2. Of course, there are slight inflow and outflow of air through a tiny clearance between the float 7 and the inner cylinder 5. However, air which has entered the space C2 must further pass through the plurality of airways A1 and go into the space C1. Thus, air reaching the space C1 from the outside past the space C3 and the space C2 is in a negligible amount. Furthermore, the plurality of upper punches P and the plurality of dies D continue to be heated by the heaters (not shown), so that the constant temperature atmosphere in the space C1 is not disturbed.

In the ascending state of the ram R, the window portion 41 of the outer cylinder 4 stays open. Except in the bottom dead center state of the ram R (not shown), however, a strong current of air is ejected upward from the plurality of blowoff ports 42*a* of the air curtain device 42 provided in the front lower part of the outer cylinder 4, whereby the space C1 is shut off from the outside space by the air current. Thus, the temperature in the space C1 does not lower.

In the above-described manner, the drawing processes of the second step are performed, and each time the ram R rotates through a constant angle, one valve umbrella portion 1 in finished form is obtained. The points to consider on this occasion are two: The first point is that as stated earlier, most of the expanded-diameter section Wa of the work W is not subjected to drawing; therefore, the inner diameter ϕ 11 of the hollow S11 inside the expanded-diameter section 111 of the semifinished product 11 (see FIG. 6*a*) is kept at ϕ 11 even in the valve umbrella portion 1 in finished form (see FIG. 6*b*). It goes without saying that the outer diameter ϕ 12 of the expanded-diameter section 111 of the semifinished product 11 is kept at ϕ 12 even in the expanded-diameter section 1*a* of the valve umbrella portion 1 in finished form.

The second point is that as mentioned above, the entire space C1 where the works W undergo drawing is held in a temperature atmosphere at a constant temperature. In warm forging with a large number of steps, this point is of vital importance. Even at a moment when the work W is pulled out of the die D, the space C1 is held at the same temperature as that of the work W. Thus, the temperature of the work W does not lower, so that work hardening does not occur in the work W. Consequently, even in the case of many steps, it becomes possible to minimize excess steps, such as intermediate heat treatment, and continuously proceed with the drawing steps. As a result, the operating efficiency is markedly improved.

A further point to be noted is that the entire configuration can be rendered very compact. That is, what is used is an ordinary rotary press device, and only the periphery of the die set DS is surrounded by the outer cylinder 4 and the inner cylinder 5. Thus, the capability of simple construction, without the need for a special extensive heating device, can be said to be a great feature of the present invention. Needless to say, all the processes of the above second step can be performed not only by the rotary press device, but by a transfer forging device (not shown) involving ordinary linear movements.

INDUSTRIAL APPLICABILITY

The present invention divides the entire procedure for manufacturing of a valve umbrella portion, which serves as the core of a hollow engine valve, into two steps, and discloses a concrete method for performing, in particular, the second step by warm forging. In the midst of growing demands for economical cars with low fuel consumption for the promotion of countermeasures against global warming, the present invention is firmly believed to increase in applicability in the future automobile industry.

That is, hollow engine valves have often been used as exhaust valves containing sodium sealed up therein. Recently, attention has been paid to their light weight, and needs for them as intake valves have been increased. When the hollow engine valve is used as an intake valve, heat resistance required is not so high as for use as an exhaust valve. Thus, the range of materials which can be used is much wider.

Among steel materials as the above materials, however, are many ones with poor cold forgeability, such as materials of a high carbon content included in JIS 4311 heat resisting steels. Such materials are difficult to draw by cold forging, but poses problems about finish accuracy if their drawing is carried out by hot forging. Thus, it is the most desirable method to apply warm forging which can be adapted for any materials and provide satisfactory finish accuracy.

The present invention has focused attention on this warm forging, has developed a technology including a device which draws only the body of a semifinished product, without drawing its expanded-diameter section, and has also developed a technology including a device capable of drawing the system, as a whole, in a constant temperature atmosphere. Through these achievements, the present invention discloses technical contents which enable warm forging of a valve umbrella portion of a hollow engine valve to be performed smoothly even when almost any materials are selected. The present invention is considered to be capable of contributing greatly to setting the most desirable direction for the future automobile industry.

EXPLANATIONS OF LETTERS OR NUMERALS

1 Valve umbrella portion
1*a* Expanded-diameter section
1*b* Body
11 Semifinished product
111 Expanded-diameter section
112 Body
2 Hollow shaft portion
2A Round solid bar
2B Intermediate member
2C Hollow
Shaft end sealing material
3A Round solid bar
3B Intermediate member
3C Hollow
4 Outer cylinder
41 Window portion
42 Air curtain device
42*a* Blowoff port
5 Inner cylinder
5*a* Protrusion
6 Shielding tube
7 Float
A1 Airway
A2 Airway
B Press bed
C1 Space
C2 Space
C3 Space
D Die
D1 Die
D2 Die
DM Die
DN Die
DR Door
DS Die set
Dr Inner diameter
GP Guide post
H Hanger
HS Heat insulating layer
P Upper punch
P1 Upper punch
PR Press device
R Ram
S Hollow
S1 Hollow
S11 Hollow
UR Upper ram
V Hollow engine valve
W Work
Wa Expanded-diameter section
Wb Body
X Direction
Y Hollow engine valve
Z Direction
h11 Height
h12 Height
h13 Height
h14 Height
h15 Height
h16 Height
h17 Height
h18 Height
h20 Height
h21 Height
h22 Height
h30 Height
h31 Height
α Direction
β Direction
ϕ 10 Outer diameter
ϕ 11 Inner diameter
ϕ 12 Maximum outer diameter
ϕ 13 Inner diameter
ϕ 14 Outer diameter

The invention claimed is:

1. A method for manufacturing a valve umbrella portion of a hollow engine valve having a valve umbrella portion hollow which opens at a side to be welded to a hollow shaft portion or to a shaft end sealing material, the valve umbrella portion hollow being formed with an expanded diameter within an expanded-diameter section of the valve umbrella portion, a maximum inner diameter of the valve umbrella portion hollow being larger than a maximum outer diameter of the hollow shaft portion, the method for manufacturing, comprising:

a first step of producing a valve umbrella portion semifinished product from a round solid bar as a raw material; and a second step of converting the valve umbrella portion semifinished product into the valve umbrella portion in finished form by warm forging, wherein the first step is adapted to obtain the valve umbrella portion semifinished product which has an expanded-diameter section integral with a body of a cylindrical shape at an end of the body, a maximum outer diameter of the expanded-diameter section being equal to a maximum outer diameter of the expanded-diameter section of the valve umbrella portion as a finished product when an expanded-diameter section side of the valve umbrella portion semifinished product is placed below, and has a cylindrical hollow having an inner diameter equal to the maximum inner diameter of the valve umbrella portion hollow of the finished product, the cylindrical hollow being open at an upper end thereof and being bottomed within the expanded-diameter section at a lower end thereof, and the second step is adapted to subject the valve umbrella portion semifinished product to forging at a temperature within a range of room temperature to 870° C. to draw an upper part of the expanded-diameter section and the body gradually in a plurality of stages in such a manner as to gradually perform drawing by use of dies for pressing the upper part of the expanded-diameter section and the body of the valve umbrella portion semifinished product, a number of the dies being equal to a number of drawing processes, and inner diameters of the dies decreasing little by little as the stages proceed, while holding an entire space itself including works, the dies, and punches at a constant temperature, thereby obtaining the valve umbrella portion as the finished product in which the maximum inner diameter of the valve umbrella portion hollow within the expanded-diameter section is held at the inner diameter of the cylindrical hollow, and the inner diameter of the valve umbrella portion hollow becomes smaller more upwardly.

2. A press device for a valve umbrella portion of a hollow engine valve, which can produce a valve umbrella portion of a hollow engine valve by the method for manufacturing according to claim 1, wherein the press device used in the second step has a heat insulating wall embracing the works, fixtures for fixing the works, the dies, and fixtures for fixing the dies, as a whole, and can hold an interior of the heat insulating wall in a constant temperature state by an effect of the heat insulating wall.

3. A hollow engine valve prepared by welding the valve umbrella portion, which has been produced by the method for manufacturing according to claim 1 to an end of a shaft end sealing material.

4. A hollow engine valve prepared by welding the valve umbrella portion, which has been produced by the method for manufacturing according to claim 1 to an end of a hollow shaft portion open at both ends, and welding a shaft end sealing material to the other end of the hollow shaft portion.

* * * * *